US008251185B2

(12) United States Patent
Manabe

(10) Patent No.: US 8,251,185 B2
(45) Date of Patent: Aug. 28, 2012

(54) ELEVATOR RESCUE OPERATION SYSTEM WITH SETTING OF PRIORITY RESPONSE FLOOR

(75) Inventor: Yoshiaki Manabe, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/014,369

(22) Filed: Jan. 26, 2011

(65) Prior Publication Data

US 2011/0120812 A1 May 26, 2011

Related U.S. Application Data

(63) Continuation of application No. PCT/JP2010/067963, filed on Oct. 13, 2010.

(30) Foreign Application Priority Data

Oct. 19, 2009 (JP) ..... 2009-240517

(51) Int. Cl.
*B66B 1/20* (2006.01)

(52) U.S. Cl. ..... 187/384; 187/313; 187/388

(58) Field of Classification Search ..... 187/247, 187/248, 313, 316, 317, 380–389, 391–393
See application file for complete search history.

(56) References Cited

U.S. PATENT DOCUMENTS 6,000,505 A * 12/1999 Allen ..... 187/391
7,182,174 B2 * 2/2007 Parrini et al. ..... 182/18
7,461,723 B2 12/2008 Kawai
7,588,126 B2 9/2009 Siikonen et al.
7,594,564 B2 * 9/2009 Siikonen et al. ..... 187/384
7,621,378 B2 * 11/2009 Kawai ..... 187/313
7,637,354 B2 * 12/2009 Kawai ..... 187/313
7,669,695 B2 3/2010 Hikita et al.
7,677,363 B2 * 3/2010 Kawai ..... 187/387
7,743,889 B2 * 6/2010 Kawai ..... 187/313
7,938,232 B2 5/2011 Hikita et al.
2007/0272497 A1 11/2007 Kawai
2007/0278044 A1 * 12/2007 Hikita et al. ..... 187/247

(Continued)

FOREIGN PATENT DOCUMENTS

JP 2007-131362 A 5/2007

(Continued)

OTHER PUBLICATIONS

Y. Manabe, U.S. PTO Notice of Allowance, U.S. Appl. No. 13/014,361, dated Oct. 14, 2011, 6 pages.

(Continued)

*Primary Examiner* — Anthony Salata
(74) *Attorney, Agent, or Firm* — Foley & Lardner LLP

(57) ABSTRACT

According to one embodiment, there is provided an elevator rescue operation system to be used in a building in which a plurality of elevators are installed in parallel. The system includes a disaster detection unit configured to detect, when a disaster has occurred in the building, an occurrence site of the disaster, a priority response floor setting unit configured to set a priority response floor on the basis of the disaster occurrence site detected by the disaster detection unit, and a rescue operation unit configured to cause a corresponding elevator for a rescue operation among the plurality of elevators to respond to the priority response floor set by the priority response floor setting unit, thereby carrying out a through-car operation up to a refuge floor.

7 Claims, 6 Drawing Sheets

U.S. PATENT DOCUMENTS

| | | | | |
|---|---|---|---|---|
| 2010/0213011 | A1* | 8/2010 | Hikita et al. | 187/247 |
| 2010/0224451 | A1* | 9/2010 | Hikita et al. | 187/247 |
| 2011/0114424 | A1 | 5/2011 | Manabe | |

FOREIGN PATENT DOCUMENTS

| | | | |
|---|---|---|---|
| WO | WO 2006/085386 | A1 | 8/2006 |
| WO | WO 2007/083374 | A1 | 7/2007 |

OTHER PUBLICATIONS

Y. Manabe, U.S. PTO Notice of Allowance and Allowability, U.S. Appl. No. 13/014,361, dated Sep. 6, 2011, 6 pages.
Y. Manabe, U.S. First Office Action, U.S. Appl. No. 13/014,361, dated May 16, 2011, 8 pages.
U.S. Appl. No. 13/014,361, filed Jan. 26, 2011, Manabe.

* cited by examiner

35

Currently, this elevator is in a rescue operation.
This elevator goes to the 18th floor.

FIG. 6

44

Currently, elevators A to E are in a rescue operation.
Priority is given to the operation for the 18th floor.

FIG. 7

ELEVATOR RESCUE OPERATION SYSTEM WITH SETTING OF PRIORITY RESPONSE FLOOR

CROSS-REFERENCE TO RELATED APPLICATIONS

This is a Continuation Application of PCT Application No. PCT/JP2010/067963, filed Oct. 13, 2010, which was published under PCT Article 21(2) in Japanese.

This application is based upon and claims the benefit of priority from Japanese Patent Application No. 2009-240517, filed Oct. 19, 2009; the entire contents of which are incorporated herein by reference.

FIELD

Embodiments described herein relate generally to an elevator rescue operation system configured to carry out a rescue operation when a disaster such as a fire or the like occurs in a building by using all of elevators.

BACKGROUND

Concomitantly with the Manhattanization of buildings in recent years, elevators play an indispensable role as vertical transportation means of a building. Further, an elevator plays an important role in order that a disabled person such as a wheelchair user may move between floors.

Here, in case of fire, presently, an operation in which an elevator is shifted to a refuge floor, thereafter the operation of the elevator is stopped is to be carried out. That is, in the existing circumstances, elevators are not positively utilized as evacuation means. However, it is a hard labor to move from an upper floor to a refuge floor (normally ground floor) by using stairs, and the evacuation takes much time.

Thus, in recent years, the demand for positively utilizing elevators as evacuation means at the time of occurrence of a fire is increasing. In, for example, Pat. Document 1, as a method of efficiently evacuating personnel in a building by using elevators, a method of grouping floors to be evacuated, guiding the personnel in the building to the grouped floors, and causing the elevators to respond to the grouped floors is disclosed.

PRIOR ART DOCUMENT

Patent Document

Pat. Document 1: Jpn. Pat. Appln. KOKAI Publication No. 2007-131362

BRIEF DESCRIPTION OF THE DRAWINGS

FIG. 6 is a view showing a message display example of a display device provided in an elevator car in the first embodiment.

FIG. 7 is a view showing a message display example of a display device provided at an elevator hall in the first embodiment.

DETAILED DESCRIPTION

In general, according to one embodiment, there is provided an elevator rescue operation system to be used in a building in which a plurality of elevators are installed in parallel. The system includes a disaster detection unit configured to detect, when a disaster has occurred in the building, an occurrence site of the disaster, a priority response floor setting unit configured to set a priority response floor on the basis of the disaster occurrence site detected by the disaster detection unit, and a rescue operation unit configured to cause a corresponding elevator for a rescue operation among the plurality of elevators to respond to the priority response floor set by the priority response floor setting unit, thereby carrying out a through-car operation up to a refuge floor.

Hereinafter, embodiments will be described below with reference to the drawings.

First Embodiment

Figure 1:
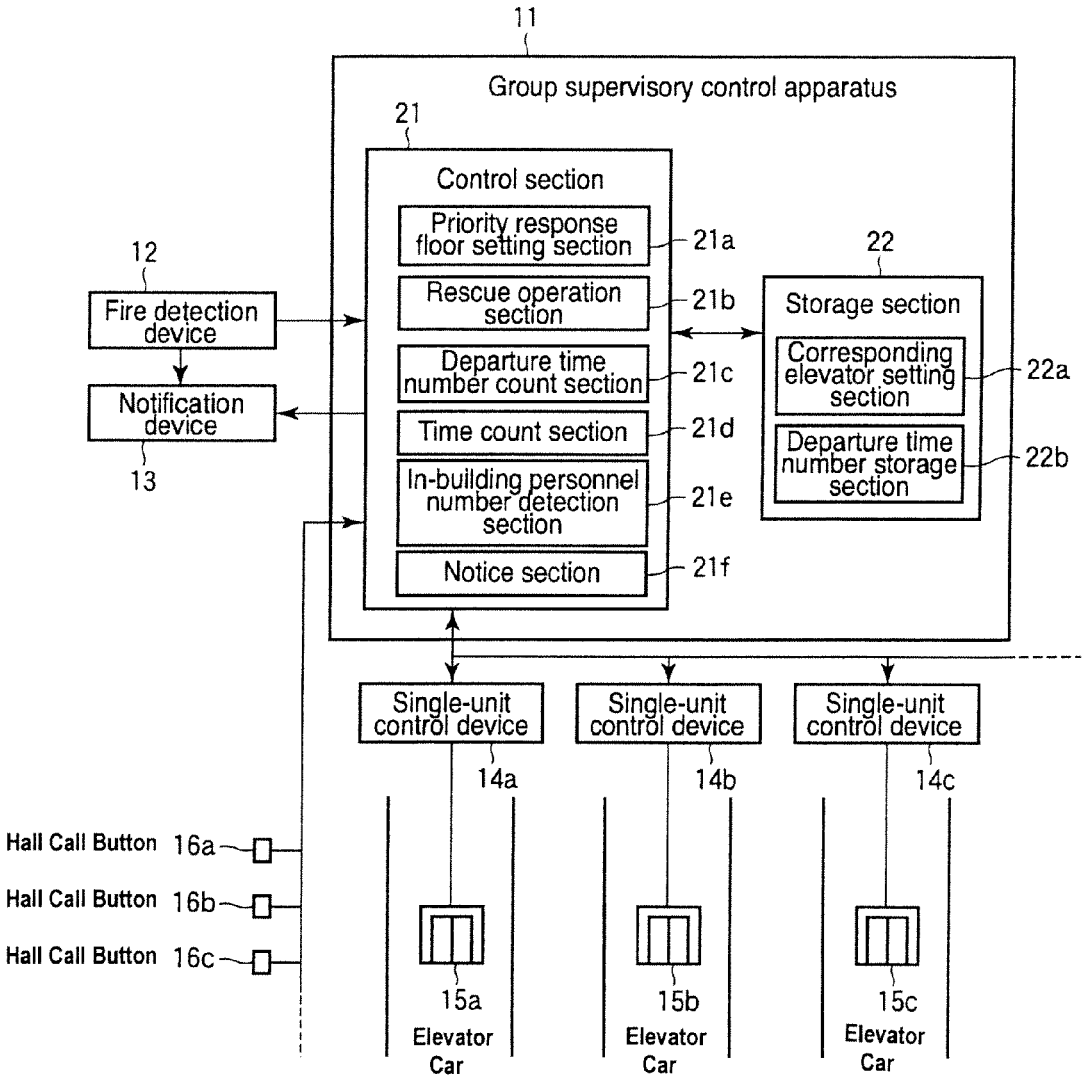
FIG. 1 is a block diagram showing the configuration of an elevator rescue operation system according to a first embodiment.

FIG. 1 is a block diagram showing the configuration of an elevator rescue operation system according to a first embodiment.

This system includes a group supervisory control apparatus 11, fire detection device 12, notification device 13, single-unit control devices 14*a*, 14*b*, 14*c*, . . . , elevator cars 15*a*, 15*b*, 15*c*, . . . , and hall call buttons 16*a*, 16*b*, 16*c*, . . . .

The group supervisory control apparatus 11 subjects a plurality of elevators installed in a building to group supervisory control. The group supervisory control apparatus 11 is constituted of a computer. The fire detection device 12 is provided on each floor of the building, detects occurrence of a fire, and notifies the group supervisory control apparatus 11 of a site of occurrence of the fire. The notification device 13 notifies evacuation warning or the like when occurrence of a fire is detected by the fire detection device 12.

Each of the single-unit control devices 14*a*, 14*b*, 14*c*, . . . is used to individually control an operation of each of the elevators such as registration of a car call, door opening/closing, and the like. The single-unit control devices 14*a*, 14*b*, 14*c*, . . . are also constituted of a computer like the group supervisory control apparatus 11. Each of the cars 15*a*, 15*b*, 15*c*, . . . carries out an ascending/descending operation by the drive of a hoisting device (not shown), and moves between floors while carrying passengers riding therein.

Further, the hall call buttons 16*a*, 16*b*, 16*c*, . . . are provided at elevator halls (elevator loading zones) of the floors. By the operation of each of the hall call buttons 16*a*, 16*b*, 16*c*, . . . , a hall call signal including information indicating the floor of the hall and destination direction is transmitted to the group supervisory control apparatus 11. As a result of this, the group supervisory control apparatus 11 selects an elevator to which the hall call is to be assigned on the basis of the operational state of each elevator, and causes the selected elevator to respond to the hall call.

Here, in this embodiment, the group supervisory control apparatus 11 is provided with a control section 21 and storage section 22.

The control section 21 is configured to carry out processing associated with operation control of each elevator, and here the control section 21 includes a priority response floor setting section 21*a*, rescue operation section 21*b*, departure time number count section 21*c*, time count section 21*d*, in-building personnel number count section 21*e*, and notice section 21*f*.

The priority response floor setting section 21*a* sets a priority response floor on the basis of a fire occurrence site detected by the fire detection device 12. The rescue operation section 21*b* causes a corresponding elevator for the rescue operation among all the elevators to respond to the priority response floor set by the priority response floor setting section 21*a*, thereby carrying out a through-car operation up to the refuge floor.

The departure time number count section 21*c* counts the number of times an elevator which has responded to the priority response floor has started without being in a full capacity state. The time count section 21*d* counts the time elapsed from the time at which the elevator that has responded to the priority response floor has started without being in a full capacity state.

The in-building personnel number count section 21*e* detects the number of in-building personnel of the priority response floor set by the priority response floor setting section 21*a*. The notice section 21*f* notifies the inside of an elevator car or the elevator hall that the elevator is in a rescue operation.

The storage section 22 stores therein various information items necessary for the operation control of the control section 21. In the storage section 22, a corresponding elevator setting section 22*a* in which information on the elevator set as the corresponding elevator for the rescue operation is stored, and departure time number storage section 22*b* configured to store therein the number of times each elevator has departed without being in a full capacity state are provided.

Figure 2:
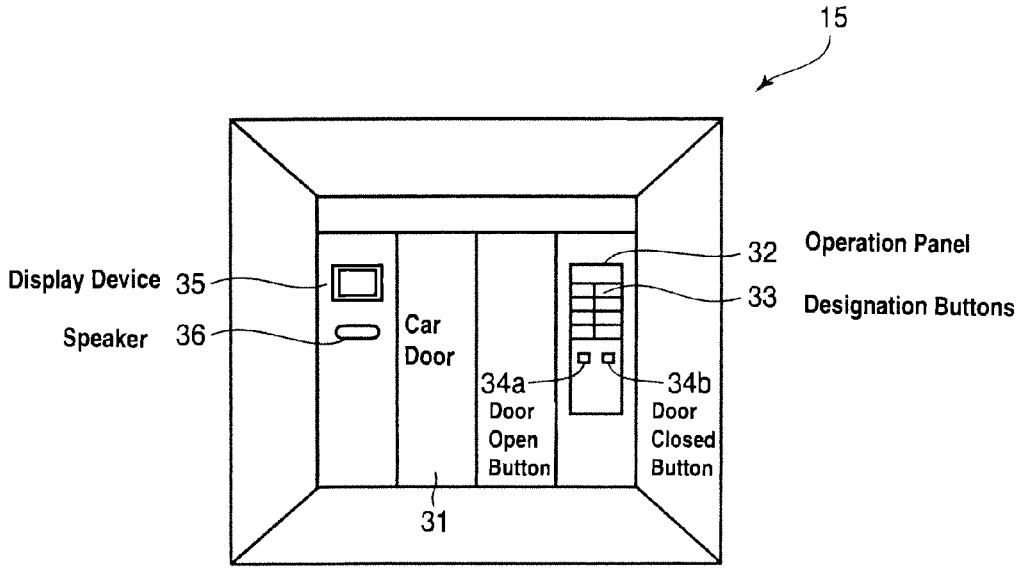
FIG. 2 is a view showing the configuration of an elevator car in the first embodiment.

FIG. 2 is a view showing the configuration of an elevator car.

A car door 31 is openably/closably provided in front of the car 15, and an operation panel 32 on which various operation buttons are arranged is provided at a position beside the car door 31. Destination floor designation buttons 33 used by passengers to designate destination floors, door-opening button 34*a*, door-closing button 34*b*, and the like are provided on the operation panel 32.

Further, a display device 35 configured to display a message, and speaker 36 configured to carry out voice announcement are provided in the car 15.

Figure 3:
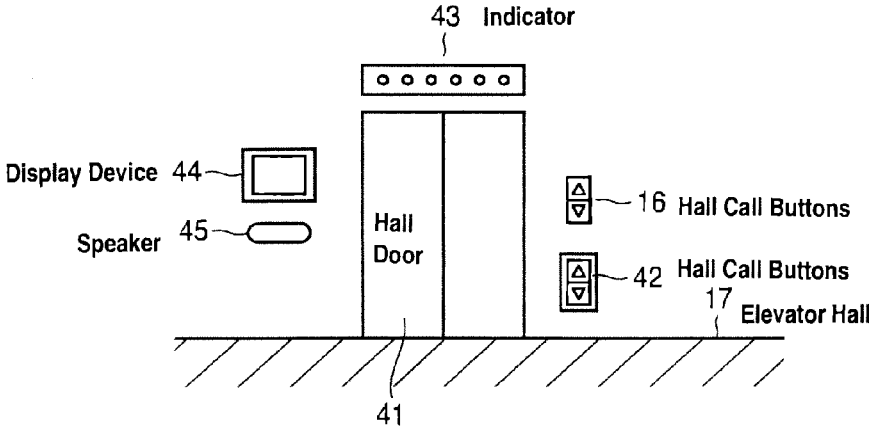
FIG. 3 is a view showing the configuration of an elevator hall.

FIG. 3 is a view showing the configuration of an elevator hall.

The elevator hall 17 is openably/closably provided with a hall door 41. The hall door 41 opens/closes in liaison with the car door 31 when the car 15 arrives at a floor. The hall call buttons 16 are provided in the vicinity of the hall door 41.

The hall call buttons 16 are operation buttons used to register a hall call and, more specifically, are constituted of an upward direction designation button and downward direction designation button used to designate destination directions. Hall call buttons 42 exclusively used for wheelchair users are provided separately from the hall call buttons 16. The hall call buttons 42 are arranged at such a height that they can be operated by a person in a wheelchair.

Further, an indicator 43 configured to display a current car position or the like is provided above the hall door 41. Furthermore, a display device 44 used to display a message, and speaker 45 used to carry out voice announcement are provided near the hall door 41.

Next, an operation of this system will be described below.

Figure 4:
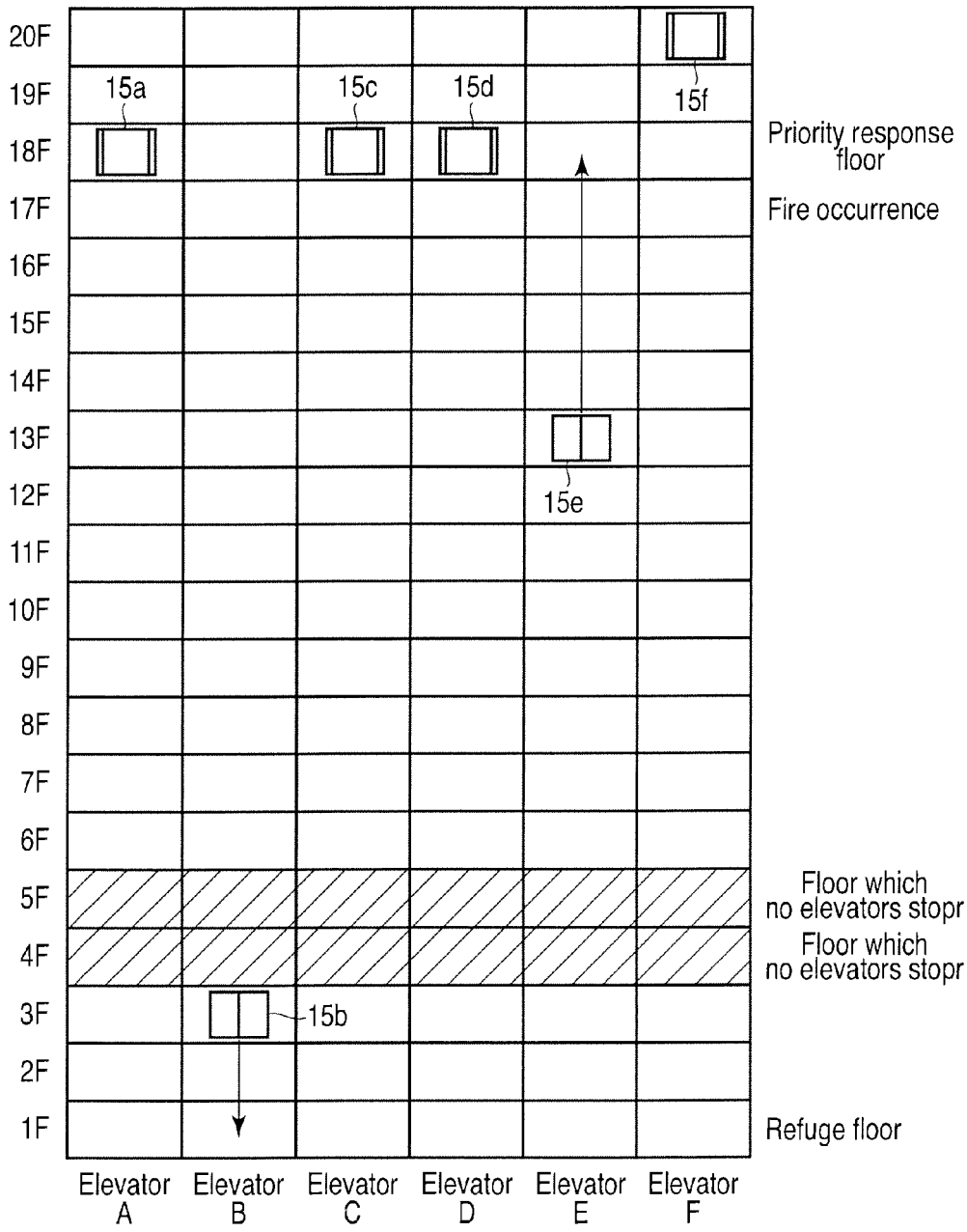
FIG. 4 is a view showing the motion of each elevator at the rescue operation time in the first embodiment.

Now, a system in which six elevators are provided in parallel in a building of 1st to 20th floors as shown in FIG. 4 is assumed. It should be noted that it is assumed that the 4th floor and 5th floor are set as way floors (floors at which the elevator does not stop). The 1st floor is set as a refuge floor at the fire occurrence time.

In the following, the six elevators are respectively called elevator A, elevator B, elevator C, elevator D, elevator E, and elevator F. Further, cars of these elevators are described as the cars 15*a*, 15*b*, 15*c*, 15*d*, 15*e*, and 15*f*, respectively.

Figure 5:
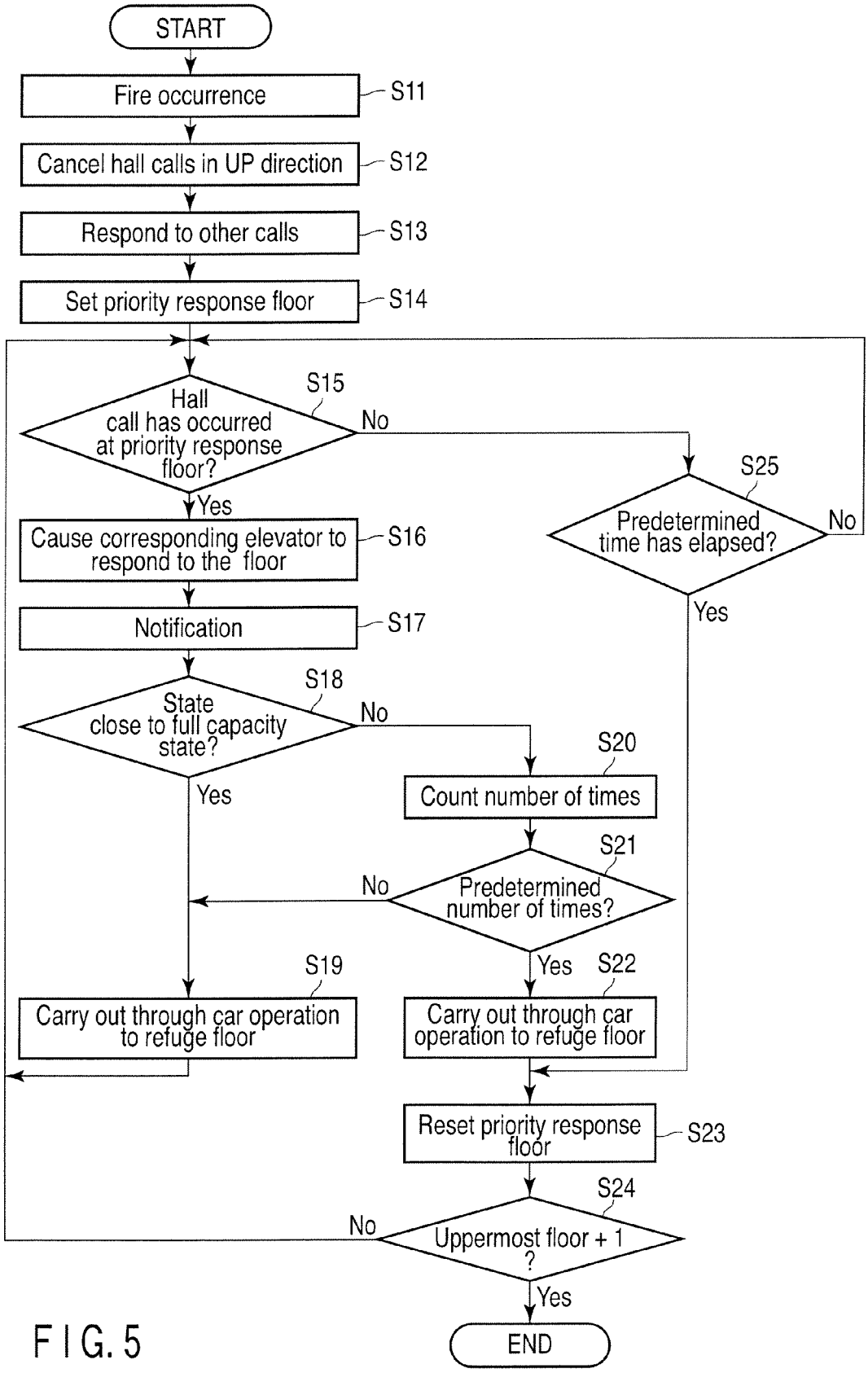
FIG. 5 is a flowchart showing a processing operation of a rescue operation at the time of occurrence of a fire in the first embodiment.

FIG. 5 is a flowchart showing a processing operation of a rescue operation at the time of occurrence of a fire in the first embodiment. It should be noted that the processing shown by this flowchart is executed by the group supervisory control apparatus 11 which is a computer by reading a predetermined program.

When a fire breaks out in a building, the fire occurrence site (floor at which the fire has broken out) is detected by the fire detection device 12, and a detection signal thereof is supplied to the group supervisory control apparatus 11 (step S11). As a result of this, the control section 21 provided in the group supervisory control apparatus 11 switches the mode from the normal operation mode to the rescue operation mode. Further, the control section 21 firstly cancels all of currently registered hall calls in the UP direction (upward direction), thereby inhibiting in-building personnel from moving in the upward direction (step S12).

Further, the control section 21 causes each elevators to respond to other calls, i.e., hall calls and car calls in the DN (downward) direction (step S13), and thereafter executes the following rescue operation. It should be noted that not only the hall calls in the UP direction, but also the hall calls in the DN direction may temporarily be cancelled.

It should be noted that the "hall call" implies a signal of a call registered by the operation of one of the hall call buttons 16 provided at the elevator hall of each floor, and information on a registered floor and destination direction is included therein. This hall call signal is supplied to the group supervisory control apparatus 11, then the group supervisory control apparatus 11 selects an optimum elevator from the current operational state, and causes the selected elevator to respond to the floor at which the hall call has been registered.

Conversely, the "car call" implies a signal of a call registered by the operation of one of the destination floor designation buttons 33 provided in the car 15, and information on a destination floor is included therein. This car call signal is supplied to a corresponding one of the single-unit control devices 14*a*, 14*b*, 14*c*, . . . . For example, when a car call signal is supplied to the single-unit control device 14*a*, the single-unit control device 14*a* causes the car 15*a* to move to a destination floor designated by the operation of the destination floor designation button 33.

In the rescue operation mode, the control section 21 sets a floor (this is called a priority response floor) to which each elevator is caused to preferentially respond on the basis of the fire occurrence site detected by the fire detection device 12 (step S14).

The priority response floor is a floor adjacent to the fire occurrence site, and is basically set at a floor upwardly next to the fire occurrence floor. This is because a fire extends in the upward direction, and hence when in-building personnel are present on the floor immediately above the fire occurrence site, those personnel must be rescued with top priority.

It is assumed that in the example of FIG. 4, the fire has broken out at the 17th floor. In that case, the 18th floor is set as the priority response floor. It should be noted that the 17th floor which is the fire occurrence site is excluded from the objects of response, and it is desirable, when a fire breaks out, that an announcement that personnel in the building should quickly escape from their places be made through the notification device 13.

Here, the control section 21 determines whether or not a hall call has occurred at the priority response floor (step S15). When a hall call has occurred at the priority response floor, i.e., when in-building personnel are present on the 18th floor in the example of FIG. 4, and the hall call button 16 provided on the floor has been depressed (Yes in step S15), the control section 21 refers to the corresponding elevator setting section 22*a* of the storage section 22 to select a corresponding elevator for a rescue operation from all the elevators, and cause the selected corresponding elevator to respond to the 18th floor which is the priority response floor (step S16).

In the example of FIG. 4, elevators A to E are set as the corresponding elevators for a rescue operation. In this case, when a car call of the 1st floor has already been registered in, for example, elevator B, elevator B moves to the 1st floor, and thereafter goes to the 18th floor. Elevator unit F is free, and can respond to each floor.

Further, the control section 21 notifies the cars 15 and halls 17 that the elevators are in a rescue operation (step S17). The method of notification may be message display or voice announcement.

FIG. 6 is a view showing a message display example of the display device 35 provided in the elevator car 15.

When a corresponding elevator for the rescue operation is caused to respond to the 18th floor which is the priority response floor, a message indicating that, for example, "Currently, this elevator is in a rescue operation. This elevator goes to the 18th floor." is displayed on the display device 35. This makes it possible to prevent in-building personnel from mistakenly riding on the elevator car during the rescue operation. It should be noted that the same message may be simultaneously notified by voice by using the speaker 36.

FIG. 7 is a view showing a message display example of the display device 44 provided at the elevator hall 17.

When the rescue operation is to be carried out, at the elevator hall on each floor, a message indicating that, for example, "Currently, elevators A to E are in a rescue operation. Priority is given to the operation for the 18th floor." is displayed on the display device 44. This notifies the in-building personnel on the 18th floor that the elevator is to respond to the 18th floor, thereby making it possible to ease the personnel.

Further, the waiting time at each of floors other than the priority response floor becomes longer during the rescue operation. However, by carrying out the notification by the message at the elevator hall of each floor, it is possible to guide the in-building personnel on comparatively safe floors to evacuation using no elevators and using stairs as much as possible. It should be noted that the same message may be simultaneously notified by voice by using the speaker 44.

When the corresponding elevator has responded to the 18th floor which is the priority response floor, and in-building personnel have ridden on the car in the manner described above, the control section 21 automatically registers a car call of the 1st floor which is the refuge floor to start the car. In this case, registration of car calls associated with floors other than the refuge floor is to be inhibited.

Here, the control section 21 determines whether or not the car starts in a state close to the full capacity state (step S18). Here, "the state close to the full capacity state" is defined as a state where load of the car is about 80% of the rated load determined for the car 15. The movable load of the car 15 is detected by a load sensor (not shown), and it is determined from the detected movable load whether or not the state is close to the full capacity state. When the state is close to the full capacity state (Yes in step S18), the control section 21 causes the elevator to carry out a through-car operation as it is up to the 1st floor which is the refuge floor (step S19).

On the other hand, when the car is not in the state close to the full capacity state, that is, when the elevator starts while leaving a slight margin of capacity (No in step S18), the control section counts the number of times of departure in such a state, and stores the counted number in the departure time number storage section 22*b* (step S20).

When the number of times of departure stored in the departure time number storage section 22*b* reaches a number of times (for example, 5 times) set in advance as a condition for switching the priority response floor (Yes in step S21), the control section 21 determines that there are no in-building personnel on the current priority response floor, causes the elevator to carry out a through-car operation to the 1st floor which is the refuge floor (step S22), and thereafter resets a priority response floor (step S23). In this case, a floor upwardly next to the current priority response floor is reset as the priority response floor. That is, in the example of FIG. 4, the 19th floor is reset as the priority response floor.

When the priority response floor is reset, the control section 21 determines whether or not the reset priority response floor is the "uppermost floor+1" (step S24). When the priority response floor is not the "uppermost floor+1" (No in step S24), the flow is returned to step S15, and the same rescue operation is carried out for the reset priority response floor. Further, when the priority response floor is the "uppermost floor+1" (Yes in step S24), the control section 21 determines that there is no floor to respond to, and terminates the rescue operation.

On the other hand, when there is no hall call of the priority response floor in step S15, the control section 21 waits a predetermined time (for example, one minute) (step S25). When there is no hall call during this period (Yes in step S25), the control section 21 determines that there are no in-building personnel on the floor, and resets a priority response floor (step S23).

It should be noted that as a condition for resetting, the following condition may be added.

When the fire has extended, resetting is carried out in accordance with additional information from the fire detection device 12. In this case, the fire occurrence floor is inhibited from being set as a priority response floor. When a floor is inhibited from being set as the priority response floor, resetting is carried out.

When a hall call has occurred at the previous priority response floor, the previous priority response floor is restored to the priority response floor. Alternatively, an elevator that can respond the earliest of all the corresponding elevators is caused to respond.

As described above, according to this system, when a fire has broken out, the elevators respond to the floors preferentially from the floor closer to the fire occurrence site, and hence the in-building personnel can quickly evacuate by using the elevators without moving to other floors.

By switching the priority response floor at predetermined timing, it is possible to efficiently transport the in-building personnel on each floor to the refuge floor.

Second Embodiment

Next, a second embodiment will be described below.

In the above first embodiment, the priority response floor is switched on the basis of the number of times the corresponding elevator has started without being in a full capacity state. In the second embodiment, the priority response floor is switched on the basis of the time elapsed from the time at which the corresponding elevator has started without being in the full capacity state.

It should be noted that the apparatus configuration is identical with the first embodiment, and hence here a processing operation will be described below with reference to FIG. 8.

Figure 8:
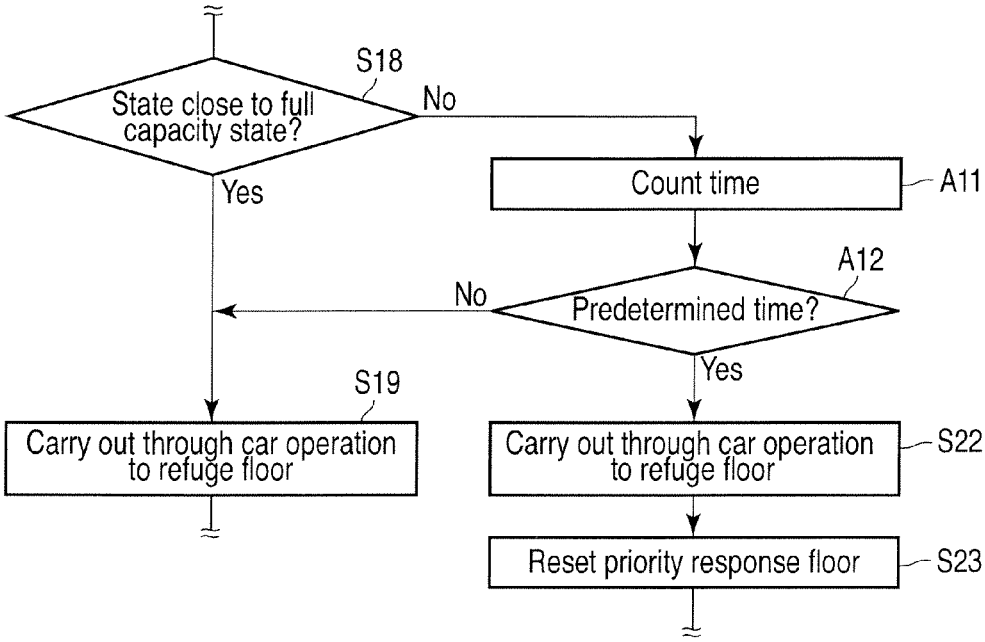
FIG. 8 is a flowchart partially showing a processing operation of a rescue operation at the fire occurrence time in a second embodiment.

FIG. 8 is a flowchart partially showing a processing operation of a rescue operation at the fire occurrence time in the second embodiment.

As described in the first embodiment, when a fire has broken out, a floor upwardly next to the fire occurrence site is set as a priority response floor, and corresponding elevators for a rescue operation respond to the priority response floor (see steps S11 to S17 of FIG. 5).

Here, when an elevator which has responded to the priority response floor has started without being in the full capacity state, a control section 21 of a group supervisory control apparatus 11 starts counting the time from that point (step A11). When the counted time is within a predetermined time (for example, one minute) (No in step A12), the control section 21 causes the elevator to carry out a through-car operation as it is to the 1st floor which is the refuge floor (step S22).

On the other hand, when the counted time has reached the predetermined time (Yes in step A12), the control section 21 determines that there are no in-building personnel on the current priority response floor, then causes the elevator to carry out a through-car operation to the 1st floor which is the refuge floor (step S22), and thereafter resets a priority response floor (step S23).

It should be noted that when any one of the elevators has responded to the priority response floor during the time counting period, the above counted time is reset and, when an elevator which has started without being in the full capacity state has appeared again, the counting of the time is resumed. That is, in the example of FIG. 4, when any one of elevators A to E has responded to the priority response floor, and has started without being in the full capacity state, if that state lasts for a predetermined time (for example, one minute), resetting of a priority response floor is carried out.

The subsequent processing is identical with the first embodiment.

As described above, by switching the priority response floor on the basis of the time elapsed from the start of the corresponding elevator without being in the full capacity state too, it is possible to efficiently transport the in-building personnel on each floor like in the first embodiment.

Third Embodiment

Next, a third embodiment will be described below.

In the first embodiment, the number of corresponding elevators for a rescue operation is determined in advance. Conversely, in the third embodiment, the number of corresponding elevators is determined stepwise in accordance with the number of in-building personnel.

It should be noted that the apparatus configuration is identical with the first embodiment, and hence here a processing operation will be described below with reference to FIG. 9.

Figure 9:
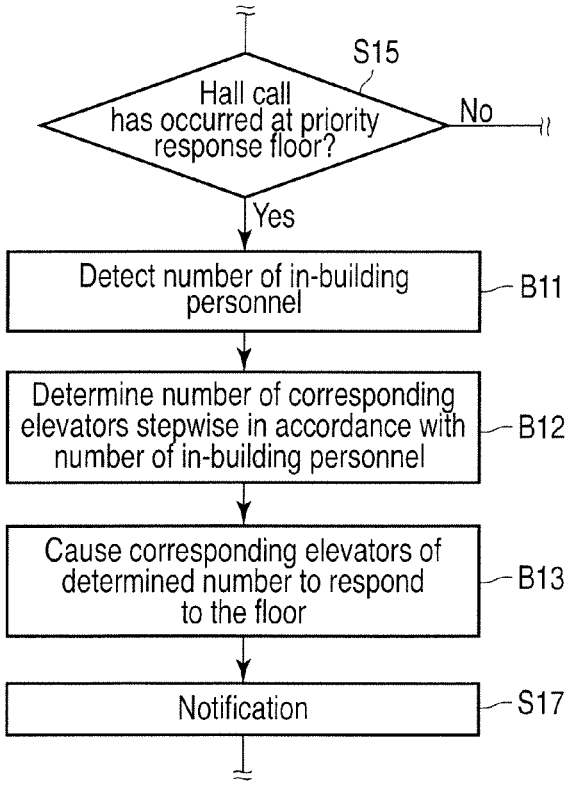
FIG. 9 is a flowchart partially showing a processing operation of a rescue operation at the fire occurrence time in a third embodiment.

FIG. 9 is a flowchart partially showing a processing operation of a rescue operation at the fire occurrence time in the third embodiment.

As described in the first embodiment, when a fire breaks out, a floor upwardly next to the fire occurrence site is set as a priority response floor, and it is determined whether or not a hall call has occurred at the priority response floor (see steps S11 to S15 of FIG. 5).

Here, when a hall call has occurred at the priority response floor, i.e., when in-building personnel are present on the 18th floor in the example of FIG. 4, and a hall call button 16 provided at the floor is depressed, a control section 21 detects the number of in-building personnel present on the priority response floor (step B11).

It should be noted that as the method of detecting the number of in-building personnel, there is, for example, a method in which a camera is provided at a predetermined place of each floor, and the number of in-building personnel present on each floor is detected from an image of the camera, a method in which the number of car-riding personnel and number of car-alighting personnel are recorded for each floor, and the number of in-building personnel currently present on each floor is detected on the basis of the recorded result, or the like. The number of car-riding personnel, and number of car-alighting personnel can be estimated from a change in the movable load of the car.

Further, when a security system provided with a function of carrying out personal authentication of personnel entering the building by means of an ID card or the like is installed in the building, the number of in-building personnel on the floors may be acquired from the security system.

When the number of in-building personnel is detected, the control section 21 determines the number of corresponding elevators in accordance with the number of in-building personnel in a stepwise manner (step B12). For example, assuming that the number of personnel who can ride on the car is 10, the number of corresponding elevators is determined stepwise in such a manner that when the number of in-building personnel is less than 10, the number of elevators is 1, when the number of in-building personnel is greater than 10 and less than 20, the number of elevators is 2, and when the number of in-building personnel is greater than 20 and less than 30, the number of elevators is 3, . . . . The elevators other than the corresponding elevators become free, and respond to each floor.

Further, the control section 21 selects the corresponding elevators for a rescue operation from all the elevators in accordance with the determined number of elevators, and causes the selected corresponding elevators to respond to the 18th floor which is the priority response floor. (step B13).

The subsequent processing is identical with the first embodiment.

As described above, by determining the number of corresponding elevators in accordance with the number of in-building personnel, it is possible, when the number of in-building personnel is comparatively large, to cause many of the corresponding elevators to respond to the floors, and carry out the rescue operation. Conversely, when the number of in-building personnel is comparatively small, it is possible to solve the problem of worsening of the waiting time of the other floors by increasing the number of free elevators.

It should be noted that in the embodiments described above, although a floor other than the fire occurrence site is set as the priority response floor, depending on the degree of the fire, the floor of the fire occurrence site may be included in the priority response floor, and the elevators may be caused to respond to the floor with first priority. However, the fire occurrence floor is very dangerous, and hence it is desirable that the floor upwardly next to the fire occurrence floor be initially set as the priority response floor.

Further, in the embodiments described above, although the description has been given assuming the rescue operation in the case of occurrence of a fire, the present invention can also be applied similarly to a case where any disaster other than a fire has occurred in a building.

As has been described above, according to these embodiments, when a fire or the like has occurred, it is possible to quickly evacuate the in-building personnel by carrying out a rescue operation preferentially from a floor close to the occurrence site of the fire or the like.

It should be noted that although some embodiments of the present invention have been described above, these embodiments are presented as examples, and are not intended to limit the scope of the invention. These novel embodiments can be implemented in other various forms, and various abbreviations, exchanges, and changes can be made within a scope not deviating from the essence of the invention. These embodiments and their modifications are included in the scope and essence of the invention, and are included in the invention described in the claims, and the equal scope thereof.

EXPLANATION OF REFERENCE SYMBOLS

11: Group supervisory control apparatus; 12: Fire detection device; 13: Notification device; 14*a*, 14*b*, 14*c*: Single-unit control device; 15, 15*a*, 15*b*, 15*c*: Elevator car; 16, 16*a*, 16*b*, 16*c*: Hall call button; 21: Control section; 21*a*: Priority response floor setting section; 21*b*: Rescue operation section; 21*c*: Departure time number count section; 21*d*: Time count section; 21*e*: In-building personnel number count section; 21*f*: Notice section; 22: Storage section; 22*a*: Corresponding elevator setting section; 22*b*: Departure time number storage section; 31: Car door; 32: operation panel; 33: Destination floor designation button; 34*a*: Door-opening button; 34*b*: Door-closing button; 35: Display device; 36: Speaker; 41: Hall door; 42: Hall call button; 43: Hall call button for wheelchair users; 43: Indicator; 44: Display device; 45: Speaker While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An elevator rescue operation system to be used in a building in which a plurality of elevators are installed in parallel, comprising:

a disaster detection unit configured to detect, when a disaster has occurred in the building, an occurrence site of the disaster;

a priority response floor setting unit configured to set a floor upwardly next to the disaster occurrence site detected by the disaster detection unit as a priority response floor, and then set a floor upwardly next to the currently set priority response floor as a next priority response floor when it is determined that there are no in-building personnel on the currently set priority response floor, and inhibit the setting and reset the next priority response floor when the disaster has spread on the floor upwardly next to the currently set priority response floor; and a rescue operation unit configured to cause a corresponding elevator for a rescue operation among the plurality of elevators to respond to the priority response floor set by the priority response floor setting unit, thereby carrying out a through-car operation up to a refuge floor.

2. The elevator rescue operation system according to claim 1, wherein the rescue operation unit causes elevators of a number determined in advance as the corresponding elevators for a rescue operation among the plurality of elevators to respond to the priority response floor.

3. The elevator rescue operation system according to claim 1, further comprising an in-building personnel number detection unit for detecting the number of in-building personnel of the priority response floor set by the priority response floor setting unit, wherein the rescue operation unit determines the number of corresponding elevators for a rescue operation stepwise from the plurality of elevators in accordance with the number of in-building personnel detected by the in-building personnel number detection unit, and causes the corresponding elevators to respond to the priority response floor.

4. The elevator rescue operation system according to claim 1, further comprising an notification unit for notifying the inside of a car of each elevator that the elevator is in a rescue operation concomitantly with the rescue operation carried out by the rescue operation unit.

5. The elevator rescue operation system according to claim 1, further comprising an notification unit for notifying an elevator hall of each floor that the elevators are in a rescue operation concomitantly with the rescue operation carried out by the rescue operation unit.

6. The elevator rescue operation system according to claim 1, wherein when a fire has broken out in the building, the disaster detection unit detects an occurrence site of the fire.

7. The elevator rescue operation system according to claim 1, wherein when a hall call occurs at a floor previously set as a priority response floor, the priority response floor setting unit restores the floor to a priority response floor.

* * * * *